US010141645B2

(12) United States Patent
Mu

(10) Patent No.: US 10,141,645 B2
(45) Date of Patent: Nov. 27, 2018

(54) MULTIBAND ANTENNA

(71) Applicant: RF Industries Pty Ltd, Seven Hills (AU)

(72) Inventor: Wei Mu, Bayswater (AU)

(73) Assignee: RF INDUSTRIES PTY LTD, Seven Hills (AU)

( * ) Notice: Subject to any disclaimer, the term of this patent is extended or adjusted under 35 U.S.C. 154(b) by 113 days.

(21) Appl. No.: 15/333,080

(22) Filed: Oct. 24, 2016

(65) Prior Publication Data

US 2017/0264019 A1 Sep. 14, 2017

(30) Foreign Application Priority Data

Mar. 10, 2016 (AU) ..... 2016900898

(51) Int. Cl.
*H01Q 5/50* (2015.01)
*H01Q 1/38* (2006.01)

(52) U.S. Cl.
CPC ..... *H01Q 5/50* (2015.01); *H01Q 1/38* (2013.01)

(58) Field of Classification Search
CPC ..... H01Q 5/50; H01Q 1/38
See application file for complete search history.

(56) References Cited

U.S. PATENT DOCUMENTS 6,909,403 B2 * 6/2005 Wang ..... H01Q 1/36 343/700 MS
2010/0283699 A1 * 11/2010 Apostolos ..... H01Q 1/3275 343/792

* cited by examiner

*Primary Examiner* — Dameon E Levi
*Assistant Examiner* — David Lotter
(74) *Attorney, Agent, or Firm* — Faegre Baker Daniels LLP

(57) ABSTRACT

An antenna comprising first and second radiating elements disposed in a collinear configuration on a dielectric substrate, wherein the first radiating element comprises a feed point. A first inter-element phasing section is conductively coupled to the first and second radiating elements, and has a meander line configuration adapted such that the first and second radiating elements radiate electro-magnetic radiation in-phase over a first range of frequencies. Third and fourth radiating elements are disposed in a collinear configuration on the substrate, and the third radiating element is electromagnetically coupled in parasitic relation to the first radiating element. A second inter-element phasing section is conductively coupled to the third and fourth radiating elements, and has a meander line configuration adapted such that the third and fourth radiating elements radiate electromagnetic radiation in-phase over a second range of frequencies which is different from the first range of frequencies.

14 Claims, 4 Drawing Sheets

(Not to scale)

MULTIBAND ANTENNA

FIELD OF THE INVENTION

The present invention relates to antenna devices, and more particularly to multiband collinear antennas.

BACKGROUND TO THE INVENTION

Series collinear antenna designs are well-known, and have a number of advantages, including ease of construction and associated affordability. Series collinear antennas consist of a number of alternate radiating elements and inter-element phasing sections which together provide a phased array antenna.

U.S. Pat. No. 6,909,403 discloses a series collinear antenna design which comprises a plurality of radiating elements and inter-element phasing sections, which are arranged alternately on a single-sided elongate substrate. When in use, the substrate is configured to be curved about a longitudinal axis which runs parallel to the arrangement of radiating elements. The inter-element phasing sections are arranged in meander line configurations which are adapted so that emissions from the radiating elements are in-phase over an intended range of frequencies.

This prior art series collinear antenna design has a number of advantages relative to its predecessors. For example, it has improved broadband characteristics when compared to series collinear antenna designs implemented in a flat configuration on a standard printed circuit board (PCB) substrate. The curved substrate increases capacitance, improving the performance of the inter-element phasing sections. The antenna may be fabricated on a flexible substrate, enabling cost-efficient manufacturing. The antenna can be constructed to exhibit low passive intermodulation (PIM) distortion.

However, the prior art antenna described above operates over only a single frequency band. Current wireless communications systems, including GSM, 3G and 4G/LTE cellular systems, employ a number of frequency bands, e.g. within an overall range of around 700 MHz to around 2700 MHz. Other bands of the radio spectrum, extending up to 300 GHz, have also been allocated by national regulators for current and future fixed and mobile wireless communication.

Multi-band communications may be accommodated by providing a corresponding plurality of separate antennas, each of which is designed to operate within a specified frequency band. However, the use of multiple separate antennas may be undesirable for a number of reasons, including cost, space constraints, complexity of wiring, reliability and visual impact.

There is, accordingly, a need for multiband antennas that are able to mitigate these disadvantages, while providing performance that is comparable to known single-band antennas. It is an object of the present invention to satisfy this need.

SUMMARY OF THE INVENTION

In one aspect, the present invention provides an antenna comprising:

at least first and second radiating elements disposed in a substantially collinear configuration on a surface of an elongated dielectric substrate, the first radiating element comprising a feed point;

a first inter-element phasing section disposed on the surface of the substrate, and conductively coupled to the first and second radiating elements, the first inter-element phasing section having a meander line configuration adapted such that the first and second radiating elements radiate electro-magnetic radiation substantially in-phase over a first range of frequencies;

at least third and fourth radiating elements disposed in a substantially collinear configuration on the surface of the substrate, wherein the third radiating element is electromagnetically coupled in parasitic relation to the first radiating element; and a second inter-element phasing section disposed on the surface of the substrate and conductively coupled to the third and fourth radiating elements, the second inter-element phasing section having a meander line configuration adapted such that the third and fourth radiating elements radiate electromagnetic radiation substantially in-phase over a second range of frequencies which is different from the first range of frequencies.

Embodiments of the present invention thus provide a novel dual-band antenna configuration which has, as one advantage, the ability to connect to a dual-band transmitter and/or receiver via a single feed line (e.g. coaxial cable) with signals within the first range of frequencies being conductively coupled to the first and second radiating elements, while signals within the second range of frequencies are electromagnetically coupled to the third and fourth radiating elements. As such, the first and second radiating elements comprise a first frequency band antenna section, while the third and fourth radiating elements comprise a second frequency band antenna section.

An antenna embodying the invention may be fabricated on a curved substrate, or on a flexible substrate which is deployed, in use, in a curved configuration. As such, embodiments of the invention are additionally able to achieve the benefits realised by the prior art antenna design which is disclosed in U.S. Pat. No. 6,909,403.

In embodiments of the invention, the first radiating element comprises a first choke structure configured to restrict generation of currents having frequencies within the first frequency range in a feed line conductively coupled to the feed point. The antenna may further comprise a second choke structure configured to restrict generation of currents having frequencies within the second frequency range in the feed line.

In embodiments, the first radiating element comprises a third choke structure configured to restrict transmission of currents having frequencies within the second frequency range into the first inter-element phasing section. The third choke structure may comprise a first slot formed longitudinally in a portion of the first radiating element adjacent to the first inter-element phasing section, through which a lead-in conductor of the first inter-element phasing section passes, wherein a longitudinal dimension of the first slot is configured such that the portion of the first radiating element in which the slot is formed comprises, in cooperation with the second choke structure, a radiating dipole adapted to resonantly couple energy within the second range of frequencies to the third radiating element.

In embodiments, the second radiating element comprises a fourth choke structure configured to restrict transmission of currents having frequencies within the second frequency range out of the first inter-element phasing section and into the second radiating element. The fourth choke structure may comprise a second slot formed longitudinally in a portion of the second radiating element adjacent to the first inter-element phasing section, through which a lead-out conductor of the first inter-element phasing section passes.

According to embodiments of the invention, the first range of frequencies comprises frequencies that are lower than the second range of frequencies. In a particular embodiment, the first frequency range substantially spans 825 MHz to 960 MHz. In some embodiments the first frequency range substantially additionally spans 698 MHz to 824 MHz.

In some embodiments, the second frequency range substantially spans 1710 MHz to 2170 MHz, and may substantially additionally span 2300 MHz to 2700 MHz.

Further features, benefits and characteristics of the invention will be apparent to persons skilled in the art of radio-frequency engineering from the following description of particular embodiments, which are provided in order to illustrate the principles of the invention and which should not be regarded as limiting its scope, as described in the preceding statements, and defined in the claims appended hereto.

BRIEF DESCRIPTION OF THE DRAWINGS

Embodiments of the invention will now be described with reference to the accompanying drawings, in which like reference numerals indicate like features, and wherein:

FIG. 6 is a graph of measured VSWR of the antenna illustrated in

FIG. 4.

DETAILED DESCRIPTION OF EMBODIMENTS

Figure 1:
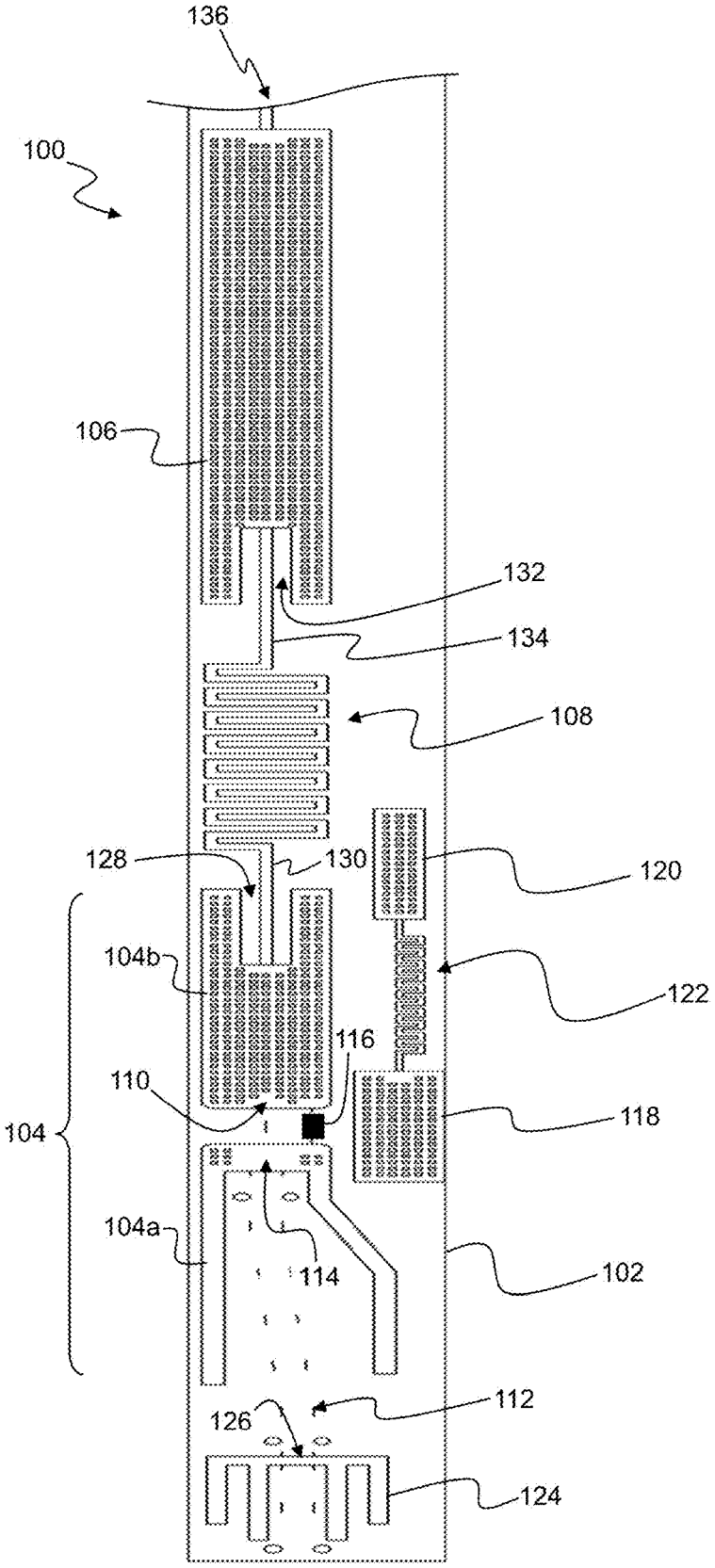
FIG. 1 shows a plan view of a portion of a dual-band antenna embodying the invention, in a flat configuration.

FIG. 1 shows a plan view 100 of a portion of a dual-band antenna embodying the invention, in a flat configuration. The antenna 100 comprises a flexible dielectric substrate 102 upon which conductive elements are formed using conventional printed circuit board (PCB) fabrication techniques. As will be appreciated, the use of well-established PCB design and manufacturing methods not only simplifies fabrication, but also provides a very high degree of precision and repeatability in the formation of the antenna elements, at a relatively low cost.

Radiating elements 104, 106 are disposed in a substantially collinear configuration on the surface of the substrate 102. The first radiating element 104 comprises two sections 104*a*, 104*b*, as will be described in greater detail below. The section 104*b* is conductively connected to the second radiating element 106 via a first inter-element phasing section 108, which has a meander line configuration as shown.

A feed point 110 is associated with the first radiating element 104, to which a feed line, e.g. the centre conductor of a coaxial cable, may be affixed by soldering or similar means. Dash lines 112 illustrate a path along which a suitable coaxial cable may be disposed adjacent to the antenna 100. An outer conductor of the coaxial feed cable may be fixed to the conductive section 104*a* at the point 114 shown in FIG. 1. In use, an inductive coil 116 may be affixed between the two sections 104*a*, 104*b* of the radiating element 104, providing DC shorting to prevent build-up of static electricity without impacting high-frequency impedance or far-field pattern performance.

A third radiating element 118 is disposed adjacent to the first radiating element 104. The third radiating element 118 is conductively connected to a fourth radiating element 120 via a second inter-element phasing section 122. Again, the second inter-element phasing section has a meander line configuration.

In accordance with the principles of the invention, the first and second radiating elements 104, 106 are configured to resonate, and therefore to efficiently radiate (or receive) electro-magnetic radiation within a corresponding first range of frequencies. The third and fourth radiating elements 118, 120 are configured to resonate, and accordingly to efficiently radiate (or receive) electromagnetic radiation over a corresponding second range of frequencies. The dimensions of the first and second radiating elements 104, 106 being greater than those of the third and fourth radiating elements 118, 120, the first and second frequency ranges are different, and more particularly the first frequency range is a lower frequency range than the second frequency range. As will be described further below, the structure 104*b* also cooperates with other elements of the antenna 100 to couple energy within the second range of frequencies to the structure comprising the third and fourth radiating elements 118, 120.

The section 104*a* of the first radiating element 104 is configured to provide a first choke structure which restricts generation of currents having frequencies within the first frequency range in the feed line which is conductively coupled to the feed point 110. The antenna 100 further comprises a second choke structure 124 which is configured to restrict generation of currents having frequencies within the second frequency range in the feed line. The outer conductor of the coaxial feed line may be conductively coupled, e.g. by soldering, at a location 126 on the second choke structure 124.

A third choke structure 128 is formed as a slot within the first radiating element segment 104*b*. The slot 128 is formed longitudinally and adjacent to the first inter-element phasing section 108. A lead-in conductor 130 of the phasing section 108 passes through the centre of the slot 128. The arrangement of the slot 128 and the central conductor 130 facilitates impedance matching within the first and second frequency ranges, and restricts transmission of currents having frequencies within the second frequency range into the first inter-element phasing section 108.

In addition, a fourth choke structure is formed in the second radiating element 106, in the form of a longitudinal slot 132 adjacent to the phasing section 108. A lead-out conductor 134 of the phasing section 108 passes through the centre of the slot 132. The arrangement of the slot 132 and central conductor 134 facilitates impedance matching within the first and second frequency ranges, and accordingly restricts transmission of currents having frequencies within the second frequency range out of the first inter-element phasing section 108 and into the second radiating element 106.

The antenna 100 may comprise one or more further collinear antenna segments, including at least one further inter-element phasing section and at least one further radiating element (not shown) connected in series via conductor 136. In use, the inter-element phasing sections 108, 122, and any further inter-element phasing sections, cause the radiating elements to radiate electromagnetic radiation substantially in-phase over the respective first and second frequency ranges, thereby providing good bandwidth and far-field radiation pattern performance.

The general operation of the antenna design represented by the embodiment 100 may be described as follows. The third radiating element 118 is disposed adjacent to a central region of the first radiating element 104, i.e. in proximity to the feed point 110. In general, the third and fourth radiating elements 118, 120 are resonantly matched to the second frequency range, whereas the first radiating element 104 is resonantly matched to the first frequency range. The longitudinal dimension (i.e. the 'depth') of the slot 128 is configured such that the portion of the conductive element 104*b* between the feed point 110 and the base of the slot 128, in cooperation with the second choke structure 124, comprises a relatively low-gain radiating dipole structure over the second frequency range. As a result, electromagnetic radiation in the second frequency range is coupled from this composite structure to at least the third radiating element 118 and, as such, the third radiating element 118 is configured in parasitic relation to the first radiating element 104. The fourth radiating element 120 is additionally conductively coupled to the third radiating element 118 via the meander line inter-element phase in section 122. The overall structure provides a novel arrangement of side-by-side collinear arrays, each substantially radiating within a different frequency band, and which are fed from a common cable feed.

Figure 2A:
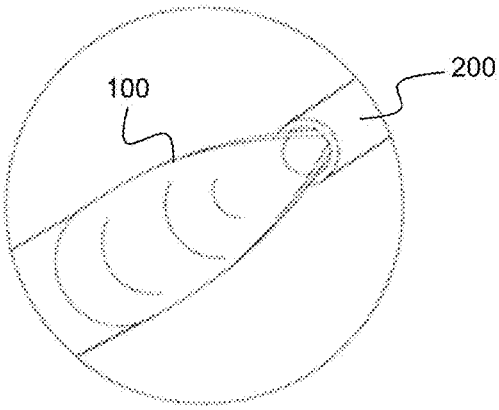
FIGS. 2A and 2B illustrate assembly of the dual-band antenna of FIG. 1 in a curved configuration within a cylindrical radome.
Figure 2B:
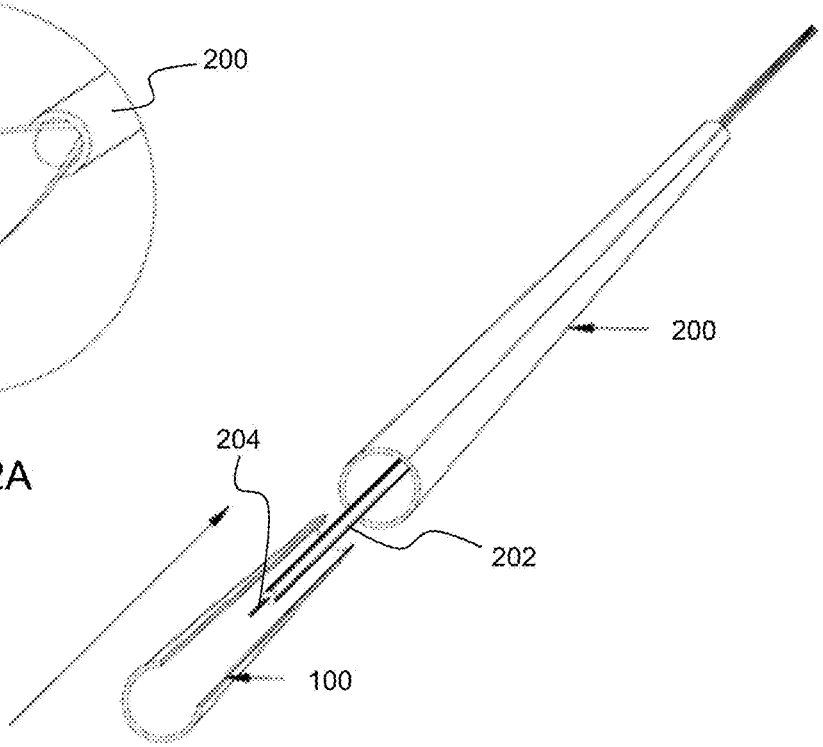

FIGS. 2A and 2B illustrate assembly of the dual-band antenna 100 of FIG. 1 in a curved configuration within a cylindrical radome 200. In particular, a coaxial feed cable 202 has a centre conductor 204 which is fixed, e.g. via a solder joint, to the feed point 110 of the antenna 100. The flexible substrate 102 of the antenna 100 is formed (e.g. rolled) into a substantially cylindrical curved configuration, which can then be inserted within the cylindrical radome 200. The cylindrical configuration provides similar advantages to those of the antenna disclosed in U.S. Pat. No. 6,909,403, with the additional advantage of dual-band operation.

As is well-known, the geometry of the radiating elements 104, 106, 118, 120, the inter-element phasing sections 108, 122, and the choke structures 104*a*, 124, 128, 132, are primarily dependent upon the target design wavelengths and bandwidths represented by the first and second frequency ranges. For example, according to theoretical considerations the lengths of the radiating elements 104, 106, 118, 120 are approximately one-half wavelength at the intended radiation frequency. Furthermore, in accordance with the principles of operation discussed above, the longitudinal dimension of the slot 128 is such that the distance from the feed point 110 to the base of the slot 128 is approximately one-quarter wavelength within the second frequency range. Broad theoretical design principles also dictate that the widths of the radiating elements 104, 106, 118, 120 are related to the intended bandwidth of operation. Similarly, the geometry and length of the meander line inter-element phase in sections 108, 122 are designed such that each radiating element in each collinear array will radiate substantially in-phase.

As is well-known to persons skilled in the art of radio frequency design, while the foregoing theoretical considerations provide a broad framework for an initial design, exact dimensions for a final design are generally determined by refining the initial design through detailed computer-aided modelling of the antenna 100 in its intended in-use configuration. A number of software packages capable of performing the required detailed electromagnetic simulations and optimisations are known.

Figure 3:
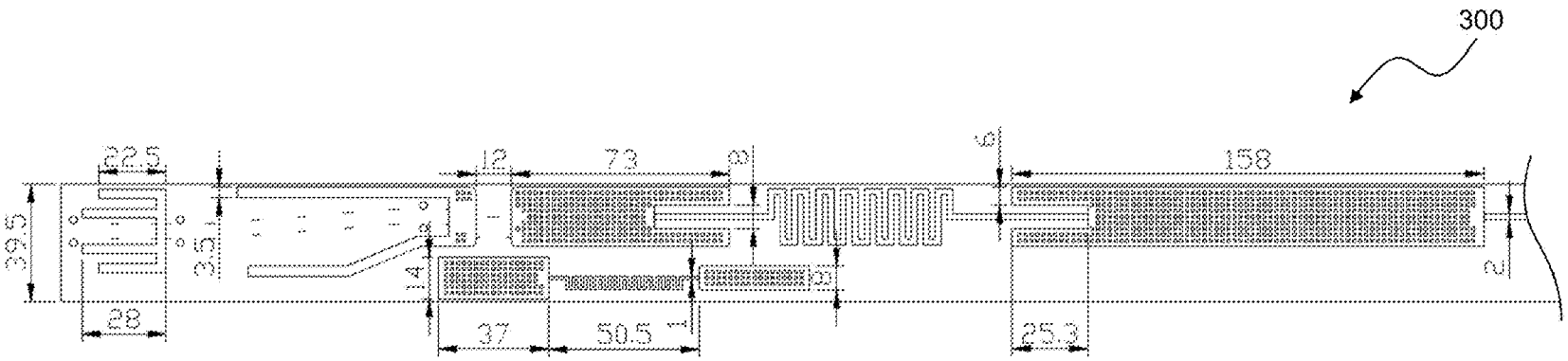
FIG. 3 illustrates dimensions of elements of a first dual-band antenna embodying the invention.
Figure 4:
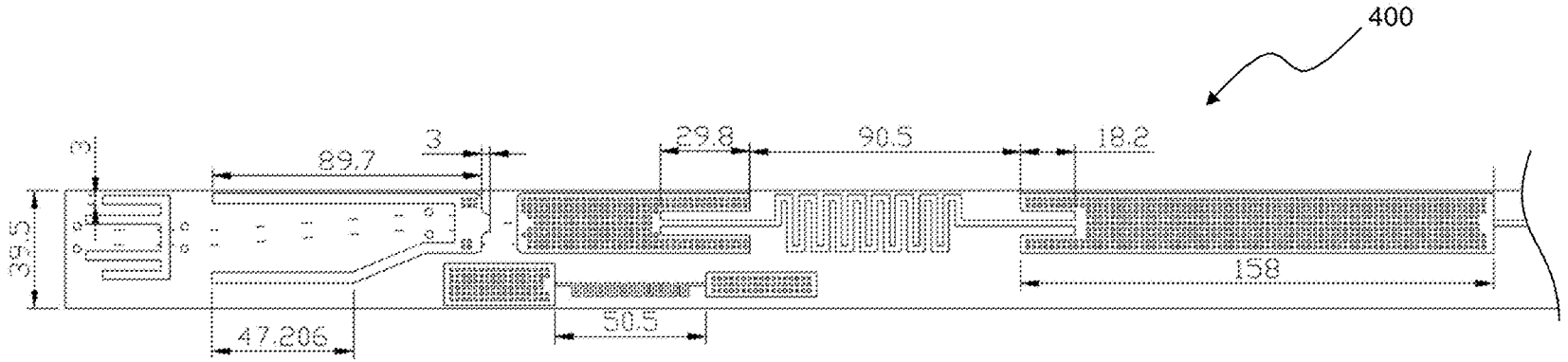
FIG. 4 illustrates dimensions of elements of a second dual-band antenna embodying the invention.

Representative dimensions of elements of antennas designed in accordance with this methodology are illustrated in FIGS. 3 and 4. In particular, FIG. 3 illustrates dimensions (in millimetres) of elements of an antenna 300 which is designed to operate within a first frequency range of 824 MHz to 960 MHz, and a second frequency range of 1710 MHz to 2170 MHz. This first frequency range is compatible with the 850 MHz band which is allocated, for example, by the US Federal Communications Commission (FCC) to GSM, IS-95 (CDMA) and 3G services. The second frequency range is compatible with the AWS (Advanced Wireless Service) band, which is allocated by the FCC to 3G and 4G services.

FIG. 4 shows representative dimensions (in millimetres) of elements of a further embodiment of the antenna 400, in which the first frequency range encompasses 698 MHz to 960 MHz, and the second frequency range encompasses 1710 MHz to 2700 MHz. Accordingly, the first frequency range in this design is compatible with the 700 MHz, 800 MHz and 850 MHz bands, which are allocated by the FCC for GSM, IS-95, 3G and 4G services, amongst other uses. The second frequency range is compatible with PCS (Personal Communication Service), AWS and BRS (Broadband Radio Service) bands which are allocated by the FCC for GSM, IS-95, 3G and 4G services. It is therefore clear that antennas designed and fabricated in accordance with the principles of the present invention are extremely well-suited to service within a broad range of current and future wireless communications networks, including all current generation mobile systems.

Figure 5:
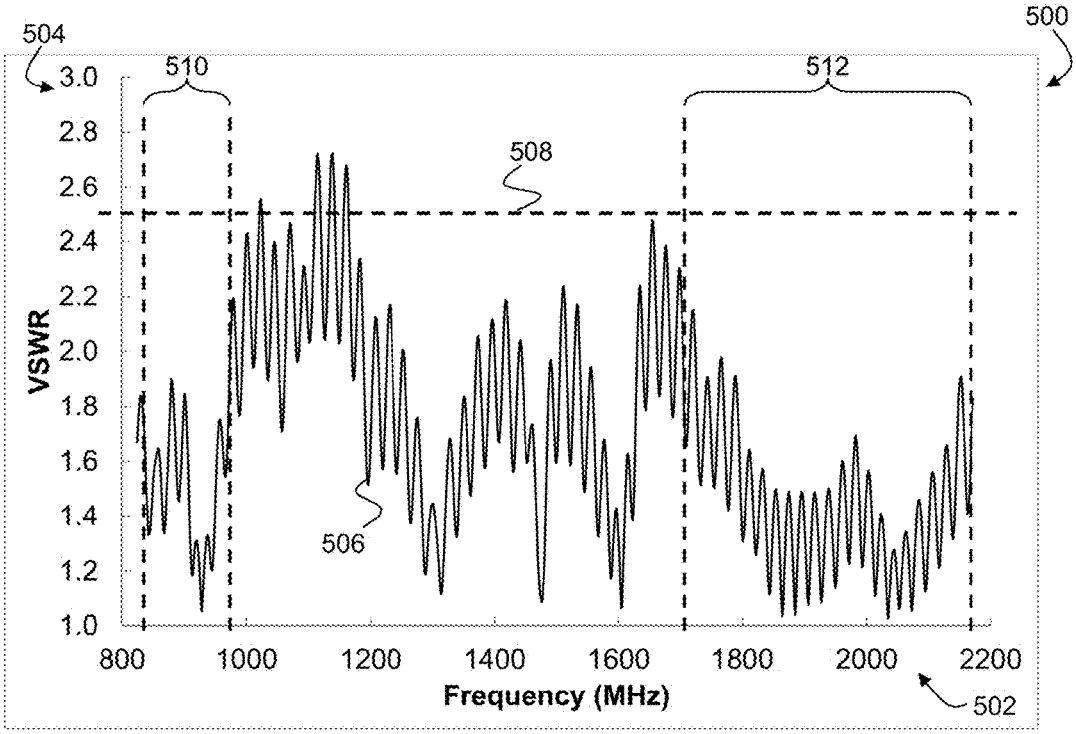
FIG. 5 is a graph of measured voltage standing wave ratio (VSWR) of the antenna illustrated in FIG. 3.

FIG. 5 shows a graph 500 of measured voltage standing wave ratio (VSWR) for an antenna fabricated in accordance with the design 300 illustrated in FIG. 3. As is known to persons skilled in the art of RF design, the VSWR is a measure of the impedance matching, and hence efficiency of the antenna, at a given frequency. Unity VSWR represents perfect matching, while higher values of VSWR represent increasing degree of mismatch. The target maximum VSWR within the first and second bands in accordance with the design goals is 2.5. In FIG. 5, the horizontal axis 502 shows frequency in megahertz, while the vertical axis 504 shows VSWR (linear, dimensionless, units). The measured VSWR as a function of frequency is represented by the trace 506. The design goal maximum is indicated by horizontal line 508. As can clearly be seen, the VSWR within the first frequency range 510, and within the second frequency range 512, is well-below the target maximum of 2.5.

Figure 6:
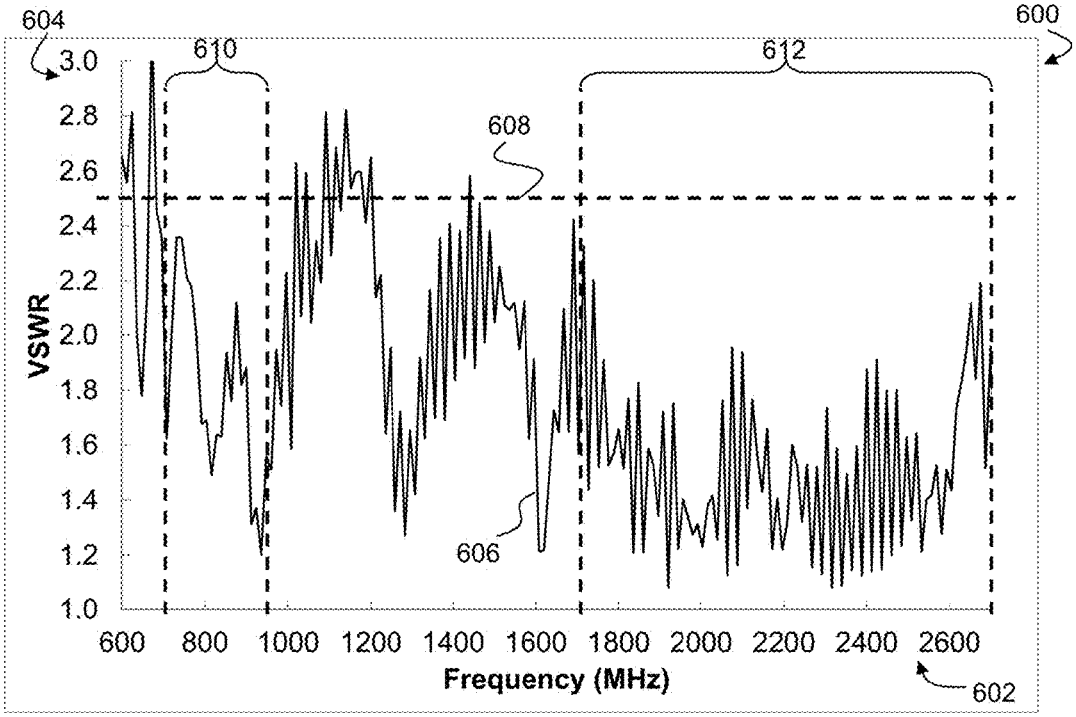

Turning now to FIG. 6 there is shown a further graph 600 of measured VSWR for an antenna fabricated in accordance with the design 400 of FIG. 4. Again, the horizontal axis 602 shows frequency in megahertz, while the vertical axis 604 shows VSWR. The measured VSWR as a function of frequency is shown by the trace 606. The design goal maximum is indicated by horizontal line 608. Again, it can readily be seen that the VSWR within the first frequency range 610 and second frequency range 612 remains below the maximum target of 2.5.

As has already been noted, it will be readily apparent to those skilled in the art that the invention described herein may incorporate further alternating radiating and inter-element phase in sections in accordance with requirements. Furthermore, embodiments of the invention are not necessarily limited to dual-band designs, and it is possible that further electromagnetically coupled radiating elements, and associated inter-element phasing sections, may be disposed in parasitic relation to a first radiating element of an antenna designed and constructed in accordance with the principles of the present invention.

It will therefore be appreciated that, although embodiments of the invention have been illustrated and described with reference to the accompanying drawings, the invention is not limited to these specific embodiments. The scope of the invention is not constrained by the disclosed embodiments, but is as defined by the following claims.

The claims defining the invention are as follows:

1. An antenna comprising:

at least first and second radiating elements disposed in a substantially collinear configuration on a surface of an elongated dielectric substrate, the first radiating element comprising a feed point;

a first inter-element phasing section disposed on the surface of the elongated dielectric substrate, and conductively coupled to the first and second radiating elements, the first inter-element phasing section having a meander line configuration adapted such that the first and second radiating elements radiate electro-magnetic radiation substantially in-phase over a first range of frequencies;

at least third and fourth radiating elements disposed in a substantially collinear configuration on the surface of the elongated dielectric substrate, wherein the third radiating element is electromagnetically coupled in parasitic relation to the first radiating element; and a second inter-element phasing section disposed on the surface of the elongated dielectric substrate and conductively coupled to the third and fourth radiating elements, the second inter-element phasing section having a meander line configuration adapted such that the third and fourth radiating elements radiate electromagnetic radiation substantially in-phase over a second range of frequencies which is different from the first range of frequencies.

2. The antenna of claim 1 wherein the elongated dielectric substrate is arranged, in-use, in a curved configuration about a longitudinal axis thereof.

3. The antenna of claim 1 wherein the elongated dielectric substrate comprises a flexible material.

4. The antenna of claim 1 wherein the first radiating element comprises a first choke structure configured to restrict generation of currents having frequencies within the first frequency range in a feed line conductively coupled to the feed point.

5. The antenna of claim 4 further comprising a second choke structure configured to restrict generation of currents having frequencies within the second frequency range in the feed line.

6. The antenna of claim 5 wherein the first radiating element comprises a third choke structure configured to restrict transmission of currents having frequencies within the second frequency range into the first inter-element phasing section.

7. The antenna of claim 6 wherein the third choke structure comprises a first slot formed longitudinally in a portion of the first radiating element adjacent to the first inter-element phasing section, through which a lead-in conductor of the first inter-element phasing section passes, and wherein a longitudinal dimension of the first slot is configured such that the portion of the first radiating element in which the slot is formed comprises, in cooperation with the second choke structure, a radiating dipole adapted to resonantly couple energy within the second range of frequencies to the third radiating element.

8. The antenna of claim 1 wherein the second radiating element comprises a fourth choke structure configured to restrict transmission of currents having frequencies within the second frequency range out of the first inter-element phasing section and into the second radiating element.

9. The antenna of claim 8 wherein the fourth choke structure comprises a second slot formed longitudinally in a portion of the second radiating element adjacent to the first inter-element phasing section, through which a lead-out conductor of the first inter-element phasing section passes.

10. The antenna of claim 1 wherein the first range of frequencies comprises frequencies that are lower than the second range of frequencies.

11. The antenna of claim 1 wherein the first frequency range substantially spans 825 MHz to 960 MHz.

12. The antenna of claim 11 wherein first frequency range substantially additionally spans 698 MHz to 824 MHz.

13. The antenna of claim 1 wherein the second frequency range substantially spans 1710 MHz to 2170 MHz.

14. The antenna of claim 13 wherein the second frequency range substantially additionally spans 2300 MHz to 2700 MHz.

* * * * *